United States Patent [19]

Nakanishi

[11] Patent Number: 4,939,552

[45] Date of Patent: Jul. 3, 1990

[54] COPYING APPARATUS WITH DRUM OR FIXING ROLLER CLEANING BELT DRIVEN FROM DOCUMENT SCANNER

[75] Inventor: Masahiro Nakanishi, Osaka, Japan

[73] Assignee: Minolta Camera Kabushiki Kaisha, Osaka, Japan

[21] Appl. No.: 238,821

[22] Filed: Aug. 31, 1988

[30] Foreign Application Priority Data

Aug. 31, 1987 [JP] Japan ..... 62-133322[U]
Aug. 8, 1988 [JP] Japan ..... 63-105089[U]
Aug. 11, 1988 [JP] Japan ..... 63-106251[U]

[51] Int. Cl.[5] ..... G03G 21/00; G03G 15/20

[52] U.S. Cl. ..... 355/300; 355/235; 355/283

[58] Field of Search ..... 355/233, 235, 283, 300

[56] References Cited

U.S. PATENT DOCUMENTS 3,471,882 10/1969 Lawes et al. ..... 355/300 X
3,883,921 5/1975 Thetta et al. ..... 355/283 X
4,366,219 12/1982 Beery ..... 355/235 X
4,540,273 9/1985 Tamura ..... 355/235

FOREIGN PATENT DOCUMENTS 60-156086 8/1985 Japan .

*Primary Examiner*—Joan H. Pendegrass
*Attorney, Agent, or Firm*—Wenderoth, Lind & Ponack

[57] ABSTRACT

A cleaning device for cleaning the surface of an element of a copying apparatus to be cleaned by contacting a cleaning web therewith is connected to a driving mechanism of a scanning member of the copying apparatus and is driven in correlative movement with the scanning member. It is driven only when the scanning member returns to its original position by a one way clutch and by a constant amount of movement irrespective of the amount of movement of the scanning member.

18 Claims, 11 Drawing Sheets

COPYING APPARATUS WITH DRUM OR FIXING ROLLER CLEANING BELT DRIVEN FROM DOCUMENT SCANNER

BACKGROUND OF THE INVENTION

1. Technical Field of the Invention

The present invention relates to an electrophotographic copying apparatus arranged for copying an image by exposing the image by a scanning system.

2. Brief Description of the Prior Art

In an electrophotographic copying apparatus, an electrostatic latent image is first formed by exposing an image, on a photoconductive drum by slit exposure and then transferring a toner image onto a sheet of copy paper after developing the image by a toner development. The transferred paper is then transported to a fixing unit for undergoing a fixing procedure by pressure and heat on the toner image transferred, and thereafter, the paper is discharged.

One the photoconductive drum, cleaning is being carried out even after transferring is finished for removing residual toner which remains thereon. At the fixing unit, cleaning is also carried out in order to prevent the offset phenomenon whereby the image is transferred again to another portion of the transfer sheet since softened and melted toner is stuck to a fixing roller which contacts the surface of the transfer sheet carrying toner image thereon.

A Japanese Published Unexamined Patent Application No. 78072/1982, for instance, discloses a device which is arranged to remove toner stuck to a fixing roller and the like of a copy machine. The device is designed to wind a cleaning web around a supplying roller which is pressed on a roller to be cleaned and then the cleaning web is rolled up successively by a take-up roller. The take-up roller is driven by a separate motor for a predetermined period of time corresponding to a movement of a copying machine and the quantity of cleaning web delivered corresponds with a movement of the copying machine.

The device which has the same structure as described above will be explained with reference to FIGS. 1 and 2.

The cleaning web 101 which is wound around a web roller 102 is rolled up by a take-up roller 104 over a pressure roller 103, and the toner stuck to a fixing roller 100 is removed by pressing the cleaning web 101 to the fixing roller 100 by the pressure roller 103. The pressure roller 103 and the take-up roller 104 are rotatably driven by a driving motor 105 through a series of gears 106. In order to pervent the cleaning web 101 from loosening, the circumferential velocity of the takeup roller 104 is arranged to be faster than that of the pressure roller 103, and a sliding mechanism such as torque limiter 107 is provided at one end of the roller 104 since the circumferential velocity increases corresponding to the increased thickness of the cleaning web 101 being rolled up.

At the other end of the take-up roller 104, one way clutch 108 is provided to prevent the cleaning web 101 from reverse movement. The web roller 102 is freely rotatable and brake is applied by a brake plate 109 biased by a torsion spring **109*a* provided for preventing the cleaning web 101** from loosening.

With the structure described above, cleaning the surface of the fixing roller 100 is carried out by its rotation in close contact with the cleaning web 101, which is driven by the driving motor 105 for a predetermined period of time corresponding to a movement of a copying machine. The fixing roller 100 is thus cleaned always by a new portion of the cleaning web 101. However, in the structure described above, a separate driving motor 105 is required for moving the cleaning web 101, and as a consequence, it becomes necessary to provide a control device to actuate the driving motor 105 corresponding to the movement of copying operation, thus increasing the cost of the apparatus because of the necessity of providing many expensive component parts.

SUMMARY OF THE INVENTION

The first object of the present invention is to provide a copying apparatus capable of economically accomplishing the object of cleaning by rolling up a cleaning web at a proper time without providing an extra driving source and control circuit.

The second object of the present invention is to provide a copying apparatus capable of properly rolling up a cleaning web at a proper time by connecting a driving means provided for a moving member which scans images of a copying machine to a moving means for the cleaning web.

The third object of the present invention is to provide a copying apparatus capable of effectively rolling up a cleaning web by variably controlling the amount of driving corresponding to the size of a paper being copied when a driving means of a moving member for scanning images drives a moving means of the cleaning web.

The fourth object of the present invention is to provide a copying apparatus capable of preventing occurrence of inferior cleaning by always rolling up a constant amount of cleaning web irrespective of the size of copy paper wherein a drive means of a moving member is connected to a moving means of a cleaning web through a means which drives only within a predetermined range in a copying apparatus where the amount of movement of a moving member for scanning images varies according to the copying condition such as the size of copy paper.

Further objects and features of the present invention will become more apparent from the following description in conjunction with the accompanying drawings.

BRIEF DESCRIPTION OF THE DRAWINGS

The like parts are given like reference numerals in the figures. The figures common to other embodiments are also adapted to each other.

DETAILED DESCRIPTION OF THE INVENTION

Embodiments of the present invention will be described below.

Figure 6:
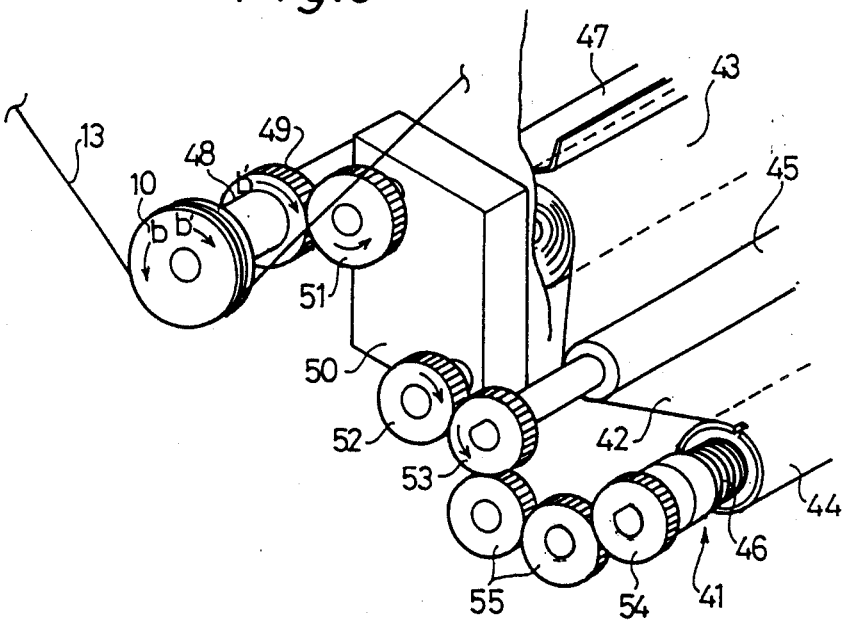
FIG. 6 is a perspective view showing a main part of a cleaning mechanism of the apparatus shown in FIG. 3.
Figure 7:
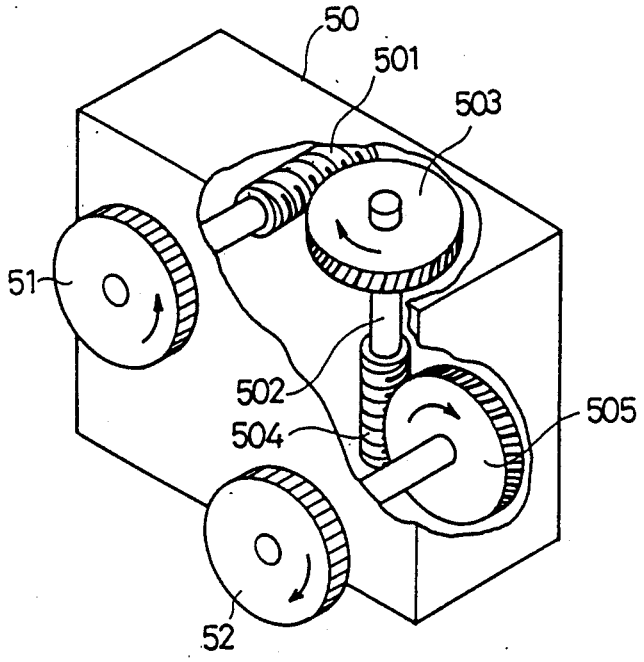
FIG. 7 is a perspective view showing an internal mechanism of a speed reducer of the mechanism shown in FIG. 6.
Figure 8:
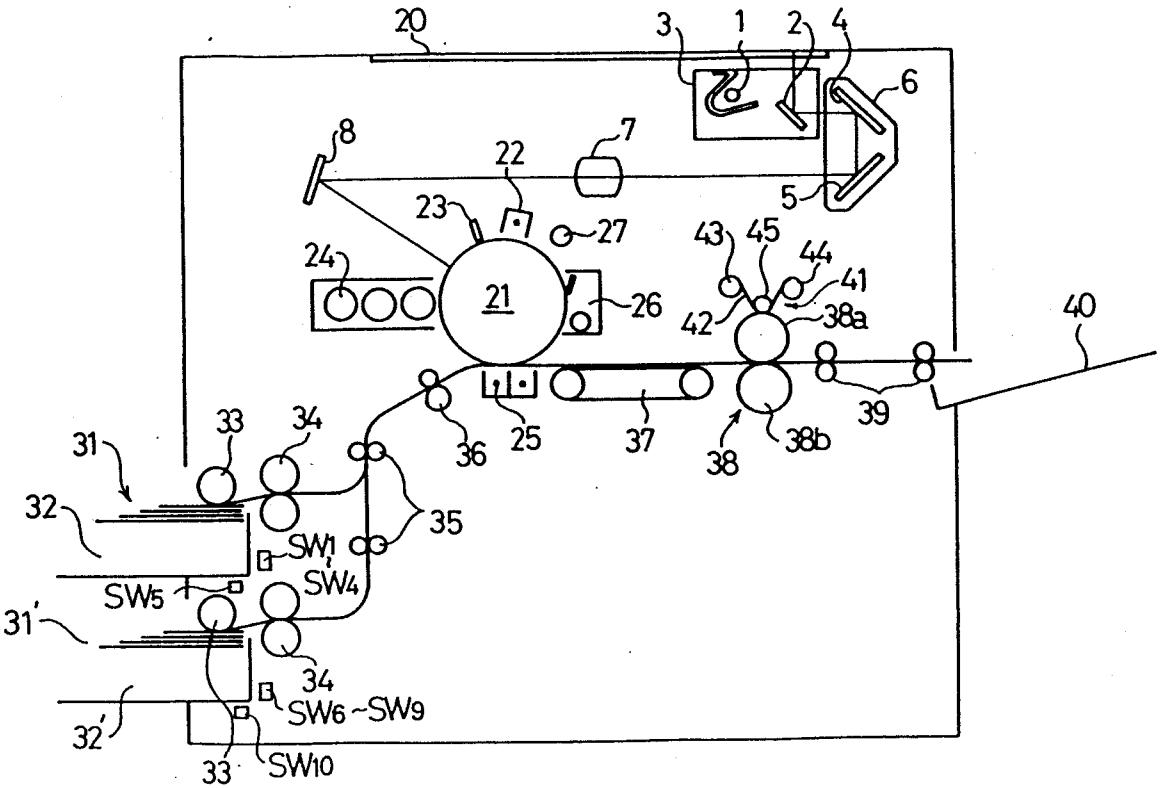
FIG. 8 is a structural view outlining the whole structure of a copying machine.

FIGS. 3 through 8 show the first embodiment of the present invention. FIG. 8 illustrates the whole a copying machine in the embodiment.

The copying machine includes a scanning optical system comprising a scanner 3 comprised of an exposure lamp 1, a first mirror 2 or the like, a movable member 6 holding a second mirror 4 and a third mirror 5, a lens 7 and a fourth mirror 8. The scanner 3 and the movable member 6 are disposed on an unillustrated guide rail movable reciprocatively to the direction of arrows s and s' in FIG. 3.

Figure 1:
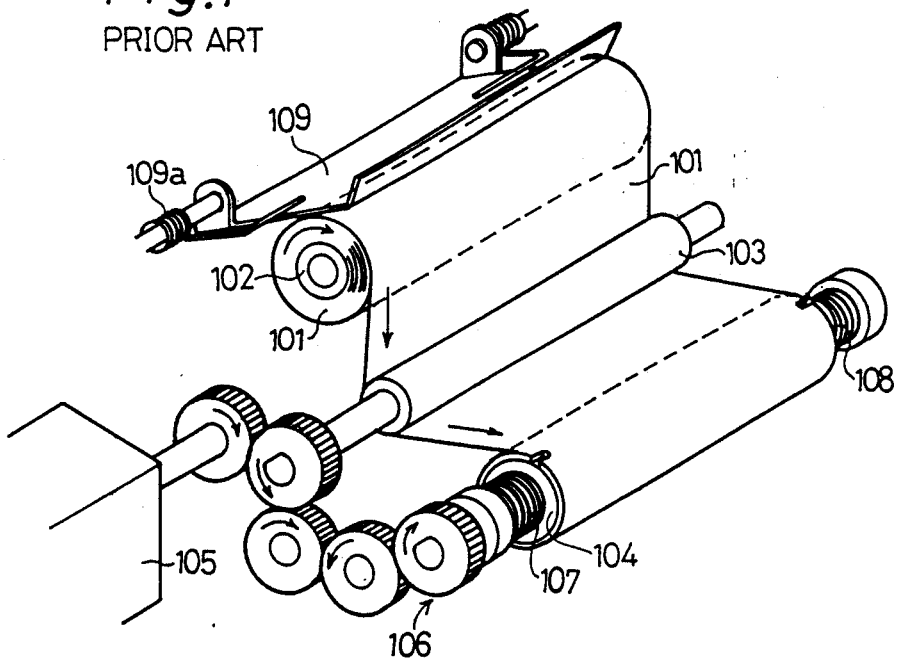
Fig.1 PRIOR ART
FIG. 1 is a perspective view showing a cleaning device of a fixing roller used in a conventional copying machine.
Figure 2:
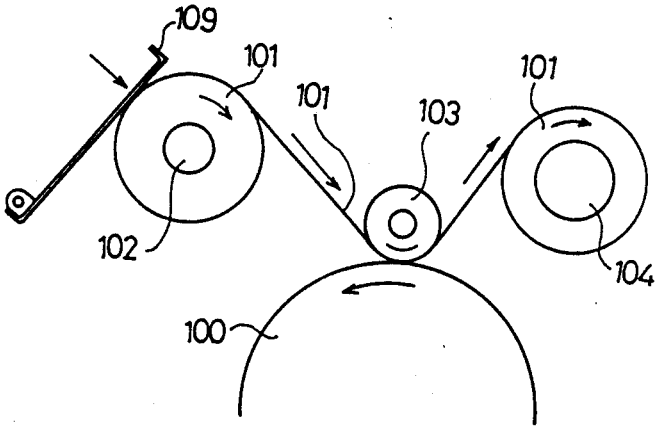
Fig.2 PRIOR ART
FIG. 2 is a side view of the device in FIG. 1 but omitting a driving system.
Figure 3:
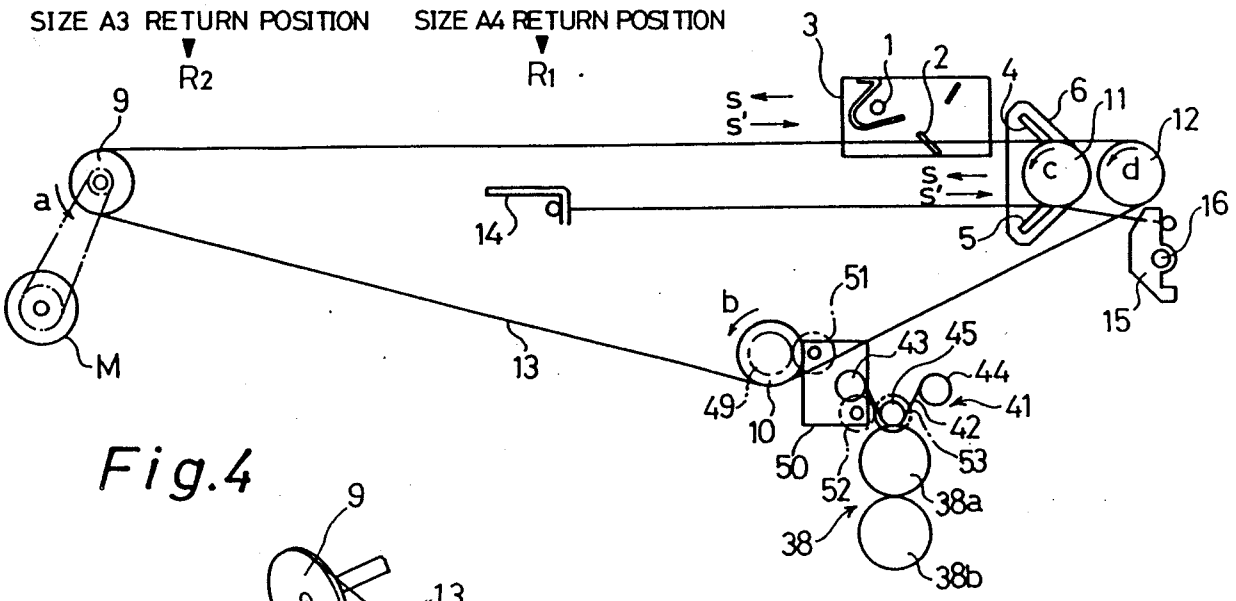
FIG. 3 is a schematic view illustrating a scanning optical system and a driving system of a cleaning mechanism of a copying machine according to the first embodiment of the present invention.
Figure 4:
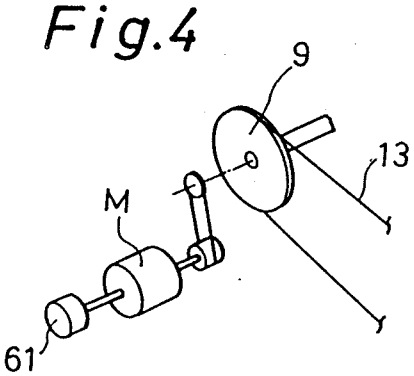
FIG. 4 is a perspective view showing how a driving motor and a scanning optical system in FIG. 3 are connected.

The driving mechanism in the optical system is comprised of a drive motor M, a drive pulley 9, an idle pulley 10, a scanning pulley 11, a fixed pulley 12 and a wire 13 as shown in FIG. 3. The drive motor M is a DC motor, to which an encoder 61 for detecting the velocity of revolution is directly connected as shown in FIG. 4, and a frequency pulse proportionate to the revolving velocity of the motor M can be obtained.

Figure 5:
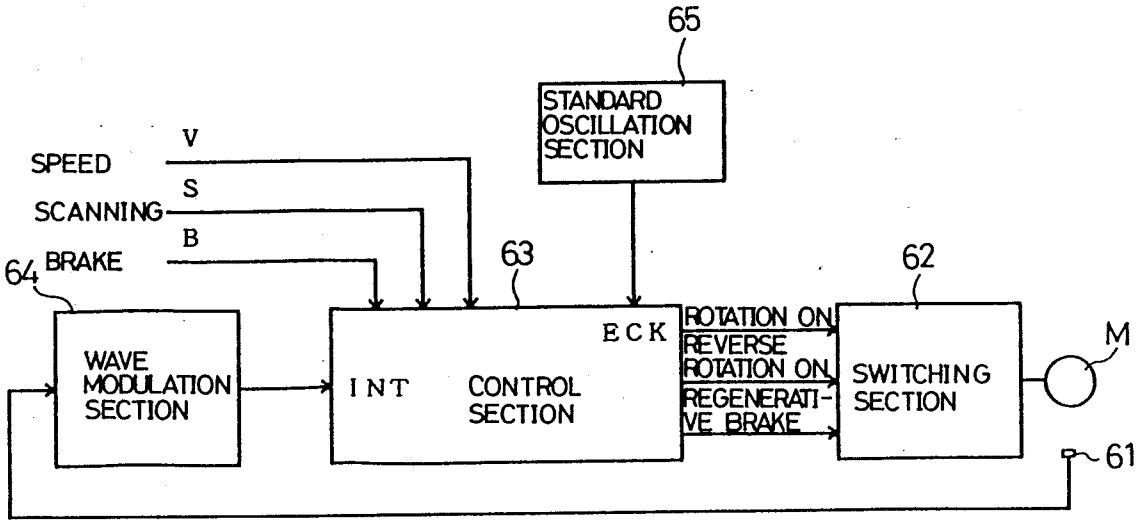
FIG. 5 is a block diagram illustrating a driving motor and a control circuit for the apparatus shown in FIGS. 3 and 4.

FIG. 5 shows a structure of a control device for controlling the velocity of the motor M. The control device has a switching section 62 for tuning on and off the motor M and switchable for normal or reverse revolution.

The switching section 62 is controlled by a control section 63 equipped with a microcomputer. In the control section 63, an 8 bit internal timer is provided for giving various control signals required for a copying operation such as a predetermined velocity V of the motor M, scanning instruction S for normal or reverse revolution of a scanning optical system and brake instruction B.

The pulse which possesses a pulse interval corresponding to an actual velocity of the motor M is given to the control section 63 via wave modulation section from the encoder 61 provided for detecting the velocity of the motor M, and further, a standard pulse of a fixed frequency for measuring the pulse interval of the pulses from the encoder 61 is given directly from a standard oscillation section 65. Accordingly, the control section 63 measures by an internal timer the number of pulses generated from the standard oscillation section 65 and computes the revolution velocity of the motor M based on the value measured.

In this embodiment, the encoder 61 generates 50 pulses per one revolution and the transmitting frequency of the oscillation section is 200 KHz. For instance, when the motor M is being revolved at a constant velocity of 400 rpm, the number of pulses of the standard oscillation to be measured by the control section 63 is set at 600. When the revolution velocity of the motor M is increased, the interval of the pulses from the encoder 61 becomes shorter, and as a result, the accuracy of velocity detection of the motor M declines. In order to prevent such problem, a frequency demultiplier may be provided with the encoder 61.

In the control section 63, a program for controlling the velocity of the motor M is stored as described above in addition to a program for performing an ordinary copying operation. The description of the copying operation is omitted since it has nothing to do with the present invention.

The control section 63 stores data of an accelerated velocity expressed by $\alpha_{on}$ which, is generated when a predetermined current is sent to the armature of the motor M for a short period of time at the start of driving, and data for negative accelerated velocity expressed by $\alpha_{off}$ when current is shut off. The section 63 further stores an equation for predicting the ON time $T_{on}$ of the motor M wherein the deviation between a predetermined velocity V and a velocity preliminarily set, $\Delta V+$ and $\Delta V-$ becomes $|\Delta V+|=|\Delta V-|$.

Under a constant velocity control, when a pulse P1 is impressed on the control section 63 from the encoder 61 corresponding to the revolution of the motor M, the control section 63 computes the energizing time $T_{oni}$ from $\alpha_{on}$, $\alpha_{off}$, $T_i$, the velocity v of the motor M and the predetermined velocity V, and accelerate the motor M by turning on the switching section 62 for the time, $T_{oni}$. After $T_{oni}$ is over, when the motor velocity becomes $V+\Delta V$, the switching section 62 is turned off and the power to the motor M is shut off and the motor M is slowed down.

Then, when the next pulse P2 is impressed to the control section 63 from the encoder 61, the time $T_{oni+1}$ wherein the motor velocity becomes as $V+\Delta V_+$ is calculated by the same operation as described above, and the switching section 62 is turned on again for the period of timer $T_{oni+1}$ for supplying the power to the motor M and the speed is accelerated. Thereafter, by repeating the same operation as described above, the velocity of the motor M can be maintained at a constant rate by driving the motor M every time it receives a signal from the encoder 61.

The driving pulley 9, idle pulley 10 and fixed pulley 12 are rotatably disposed on the main body, and the scan pulley 11 is rotatably disposed on the movable member 6. The wire 13 extends from a fixed member 14 and is wound around the scan pulley 11 and wound around the driving pulley 9, then wound around the idle pulley 10, fixed pulley 12, scan pulley 11 again and is fixed to a lever 15. The lever 15 is pivotably held by a shaft 16 and is biased by an unillustrated torsion coil spring in the clockwise direction, thereby always giving tension to the wire 13. The wire 13 is connected with a scanner 3 of the position between the scan pulley 11 and the driving pulley 9. Accordingly, the scanner 3 is moved by the drive of the motor M at the velocity of v, while the movable member 6 is moved at the velocity of v/2.

In FIG. 8, designated by numeral 20 is a document support glass table on which a document is placed, and an image of the document is scanned corresponding to the movement of the scanning optical system, and thereafter, the image is exposed onto a photoconductive drum 21 disposed under the scanning optical system. Around the photoconductive drum 21, there are disposed a charger 22, a side eraser 23, a developing unit 24, transfer/separation chargers 25, a cleaner 26 and a main eraser 27.

In FIG. 8, designated by numerals 31,31' are paper feeding sections comprised of the upper and lower paper cassettes 32,32', a paper feed roller 33 and paper handling rollers 34 disposed corresponding to each one of the paper cassettes 32,32'. The paper discharged from the paper feeding sections 31,31' are transported to register roller 36 through transporting rollers 35, and thence to a transfer section positioned between the photoconductive drum 21 and the transfer/separation chargers 25 in correlative movement with the image on the photoconductive drum 21.

The paper on which an image is transferred at the transfer section is transported to a fixing device 38 by a conveyor belt 37, whereat the image on the paper is fixed. The fixing device 38 is comprised of a fixing roller **38*a* in which a heater is provided and a pressure roller 38*b* for pressing the paper against the fixing roller 38*a*. The paper fixed at the fixing device 38 is discharged onto a discharge tray 40 by discharge rollers 39**.

In the paper feeding sections 31,31', micro switches $SW_1$–$SW_4$ and $SW_6$–$SW_9$ are provided respectively. The switches $SW_1$–$SW_4$ and $SW_6$–$SW_9$ detect the size of copy paper by the kinds of paper cassettes 32,32' mounted on the paper feeding sections 31,31' and also detect how the copy paper is positioned relative to the paper feeding direction, i.e. longitudinal or lateral direction.

The sizes of paper which are able to be copied, i.e. the sizes of paper which can be set in the cassettes 31,31', are A3, A4, A5, A6, B4, B5, B6, and the sizes A4, A5 and B5 can be selectively used either longitudinally or laterally. The switches $SW_1$–$SW_4$ and $SW_6$–$SW_9$ also detect the mounting/dismounting condition of the cassettes 32,32' which means they indirectly detect whether or not copy paper is accommodated in the paper feeding sections 31,31'. The size and direction of the copy papers accommodated in each one of the paper feeding sections 31,31' can be detected by 4 bit codes combined by ON and OF conditions of the switches $SW_1$–$SW_4$ and $SW_6$–$SW_9$.

A code table for the switches $SW_1$–$SW_4$ is shown below as an example. In the table, 0 expresses the state when the switch is turned on and 1 when the switch is turned off. In case when all the switches are turned off, it means that the cassette 32 is not mounted on the paper feeding section 31, i.e. absence of copy paper is being detected.

TABLE 1

| $SW_4$ | $SW_3$ | $SW_2$ | $SW_1$ | Copy Paper Size | No. |
|---|---|---|---|---|---|
| 0 | 0 | 0 | 0 | — | 0 |
| 0 | 0 | 0 | 1 | A6 longitudinal | 1 |
| 0 | 0 | 1 | 0 | B6 longitudinal | 2 |
| 0 | 0 | 1 | 1 | A5 longitudinal | 3 |
| 0 | 1 | 0 | 0 | B5 longitudinal | 4 |
| 0 | 1 | 0 | 1 | A4 longitudinal | 5 |
| 0 | 1 | 1 | 0 | B4 longitudinal | 6 |
| 0 | 1 | 1 | 1 | A3 longitudinal | 7 |
| 1 | 0 | 0 | 0 | A6 lateral | 8 |
| 1 | 0 | 0 | 1 | B6 lateral | 9 |
| 1 | 0 | 1 | 0 | A5 lateral | 10 |
| 1 | 0 | 1 | 1 | B5 lateral | 11 |
| 1 | 1 | 0 | 0 | A4 lateral | 12 |
| 1 | 1 | 0 | 1 | B4 lateral | 13 |
| 1 | 1 | 1 | 0 | A3 lateral | 14 |
| 1 | 1 | 1 | 1 | No cassette | 15 |

The micro switches $SW_5$ and $SW_{10}$ provided in the paper feeding sections 31,31' detect directly whether or not copy paper is in the cassettes 32,32' respectively. When copying operation is carried out, the size and direction of a copy paper is set accordingly to the size and the direction of a document being placed and it is inputted into the control means 63. The control means 63 selects a cassette according to the selection made by the paper feeding sections 31,31' while controlling the drive of the motor M to be the minimum limit corresponding to the scanning length scanned by the scanner 3 for the size of a copy paper. Accordingly, when a JIS A4 size copy paper is placed laterally, the position of the scanner 3 for start of return is set at the position of $R_1$ in FIG. 3, and in case of a JIS A3 size copy paper longitudinally placed, the position of the scanner 3 for start of return is set at the position of $R_2$ in FIG. 3.

The fixing device 38 is provided with a cleaning device 41 for cleaning and removing the toner stuck to the a fixing roller **38*a* at the time of fixing procedure. The cleaning device 41 is designed as shown in FIGS. 3, 6 and 8 to remove the toner stuck to the fixing roller 38*a* by pressing a cleaning web 42 onto the fixing roller 38*a* with a pressure roller 45, while rolling up the cleaning web wound around the web roller 43 by a take-up roller 44 over a pressure roller 45**. A releasing oil such as silicon oil is impregnated in the cleaning web by which the fixing roller is coated with the oil for preventing offsetting.

The driving device of the cleaning device 41 is now described with reference to FIG. 6. The idle pulley 10 is connected to a driving gear 49 through one way clutch 48, and the driving gear 49 is engaged with an input gear 51 of the speed reducer 50. An output gear 52 of the speed reducer 50 is engaged with a link gear 53 on one end of the pressure roller 45, and the link gear 53 is further engaged with a link gear 54 on one end of the take-up roller 44 through a pair of middle gears 55. The take-up roller 44 of the cleaning device 41 and the pressure roller 45 are thus driven in an adequate speed ratio for the amount of movement of the scanner 3 commonly using the driving motor M of the scanning optical system. The driving is correlated only with the returning movement of the scanner 3 by one way clutch corresponding to the size and direction of the copy paper thereby eliminating wasteful rolling up of the cleaning web 42.

The speed reducer 50, as shown in FIG. 7, is equipped with a worm speed reducer mechanism disposed in two stages between the input gear 51 and the output gear 52. Practically, a worm 501 directly connected to the input gear 51 is engaged with a worm wheel 503 on a middle shaft 502, and a worm 504 on the middle shaft 502 is engaged with the worm wheel 505 directly connected to the output gear 52. Thus, the velocity of revolution of the input gear 51 is reduced by the two stage worm speed reducer mechanism and output to the output gear 52. The speed reduction may be set, for instance, at 1/999 by assuming that the number of teeth of the worm 503,505 as 27 and 37 respectively.

The cleaning web 42 is delivered to the take-up roller 44 by frictional force with the pressure roller 45 and is wound thereon. The take-up roller 44 is designed to have its circumferential velocity higher than that of the pressure roller 45 in order to prevent the cleaning web 42 from loosening, and a sliding mechanism such as a torque limiter is disposed on one end of a roller shaft on which the link gear 54 is fixed, and one way clutch (not shown) is provided on the other end of the roller shaft in order to prevent the cleaning web 42 from undergoing reverse movement since the circumferential velocity tends to further increase as the diameter of the wound cleaning web 42 is increased. The web roller 43 is freely rotatable and brake force is applied by a brake plate 47 in order to prevent the cleaning web 42 from loosening.

In the structure described above, once a print switch is turned on, driving motor M of FIG. 3 starts revolving and the driving pulley 9 is rotated in the direction of arrow a, while the idle pulley, scan pulley 11 and fixed pulley 12 are rotated in the directions shown by arrows b,c and d through the wire 13. Corresponding to this movement, the scanner 3 is run along an unillustrated guide rail in the direction of arrow s at the velocity of v, while the movable member 6 runs in the direction of arrow s at the velocity of v/2.

The scanner 3, while running, scans a document by irradiating the exposure lamp 1 on the document placed on the document support glass table 20, and the reflected light is directed onto the photoconductive drum 21 through the optical system thereby forming an electrostatic latent image. When the scanner 3 has finished the scanning of the document after running a predetermined amount, the driving motor starts reverse revolution, and the scanner 3 and the movable member 6 run in the direction of arrow s' and return to the original position. In the document scanning described above, the idle pulley 10 rotates in the direction b and when it returns to the original position, it rotates in the direction b'.

The driving gear 49 at this stage rotates in the direction b' only since it is connected to the idle pulley 10 through the one way clutch 48. The rotation of the driving gear 49 is transmitted to the link gear 53 through the input gear 51 of the speed reducer 50 and the output gear 52, and the pressure roller 45 and the takeup roller 44 are driven. In the speed reducer 50, for instance, the velocity is reduced to 1/1000 and a length of the cleaning web 42 is delivered sufficient for cleaning the fixing roller 38a and for the oil coating. Thus, cleaning of the fixing roller 38a can be carried out by supplying a predetermined amount of the cleaning web 42 every time the scanning is performed in the optical system. By driving the cleaning web 42 when the scanner 3 is returned, occurrence of irregular scanning arising from variable torque load can be prevented. The moving distance for scanning is equivalent to a document support table in a document transporting type of copying machine.

When copying magnification variation is required in the embodiment, the scanning length is varied according to copy magnification. However, the transporting distance of the cleaning web 42 is determined corresponding to the scanning length, and there is no problem in avoiding wasteful consumption of the cleaning web.

Figure 9:
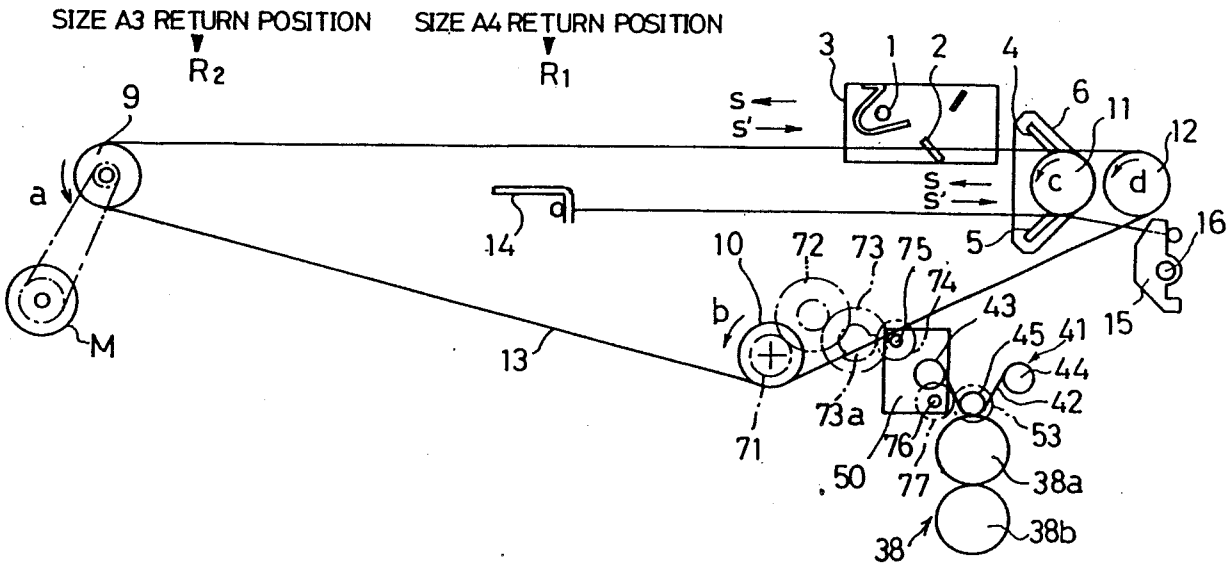
FIG. 9 is a schematic view illustrating a scanning optical system and a driving system of a cleaning mechanism in a copying machine according to a second embodiment of the present invention.

FIGS. 9 through 17 illustrate the second embodiment of the present invention. In the embodiment, the amount of a cleaning web transported is arranged to be constant irrespective of variation in size of a copy paper and the like. A driving device for a cleaning device 41 as shown in FIG. 9 of the present invention is, therefore, different from that of the one in the first embodiment, and will be described referring to FIGS. 9 through 11.

Figure 10:
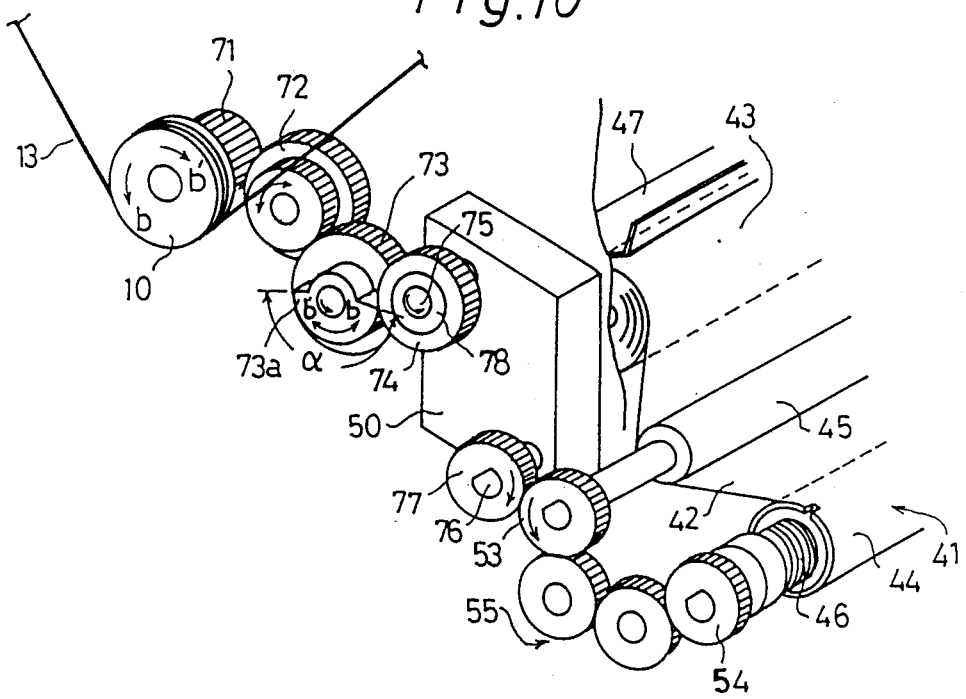
FIG. 10 is a perspective view of the main part of a cleaning mechanism shown in FIG. 9.

In FIG. 10, when a scanner 3 scans a document in the direction of arrow s, an idle pulley 10 is rotated in the direction b and when the scanner returns in the direction s', pulley 10 is rotated in the direction b'. The idle pulley 10 is directly connected to a gear 71, and is also connected to an input shaft 75 of a speed reducer 50 through gears 72,73 and 74. The gear 74 is connected to an input shaft 75 through a one way clutch 78. The input shaft 75 of the speed reducer 50 is thus arranged to be rotatably driven in the direction of the arrow only by transmission from the idle pulley 10 while the scanner 3 is being returned after movement for scanning.

Figure 16:
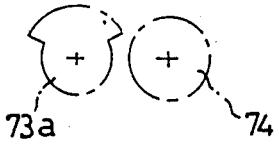
Figure 17:
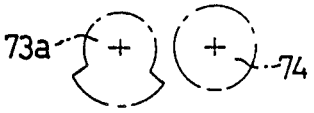

The gear 73 and 74 are connected by engaging a sector gear 73a provided on the gear 73 with the gear 74. The sector gear 73a is rotatably driven to the direction of arrow b as shown in FIGS. 15,16 and 17 from an initial position illustrated in FIGS. 9,10 and 14 corresponding to the movement of the scanner 3 starting from its waiting position, and returns to the initial position correlative with the scanner 3 which returns to the waiting position.

The range of rotation of the sector gear 73a is varied according to scan movement amount of the scanner 3; however, it always starts rotation from an initial position and returns to the initial position.

Figure 12:
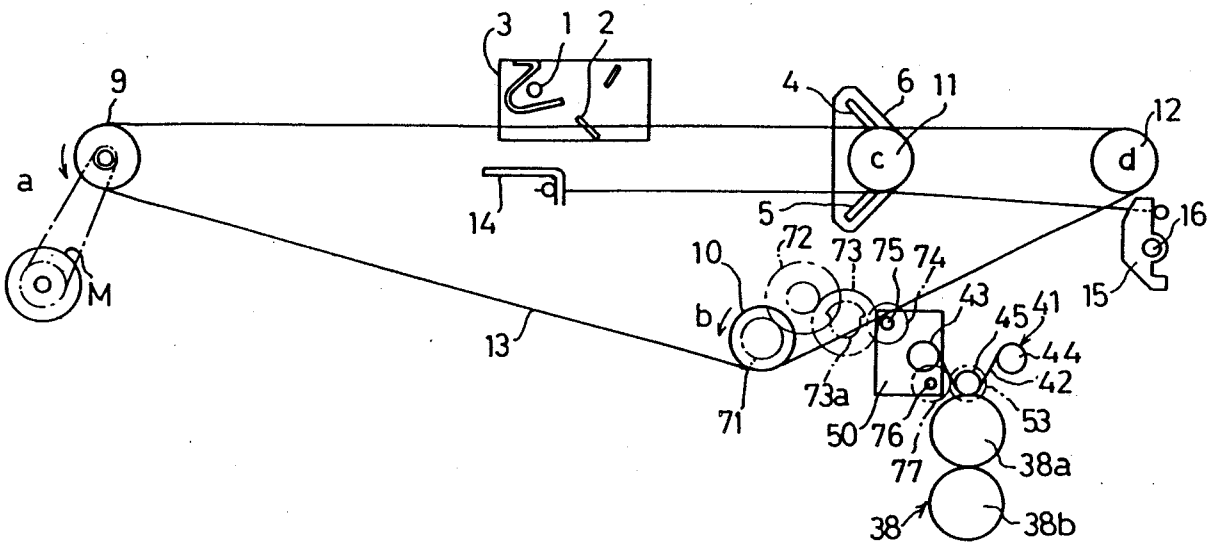
FIGS. 12 and 13 are schematic views illustrating the state of minimum and maximum scanning movement of a scanning optical system.
Figure 15:
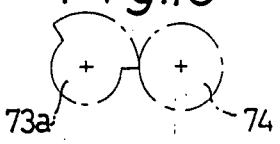

The sector angle $\alpha$ of the sector gear 73a (FIGS. 9 and 14) is such that while the scanner 3 moves the minimum scan transporting amount to $R_1$ position in FIG. 9 and to the position as shown in FIG. 12, sector gear engages with the gear 74 as shown in FIG. 15, and even if the scanner 3 is transported for scanning in excess of the minimum scan transporting amount corresponding to the size of copy paper, the sector gear 73a discontinues the transmission to the gear 74 and comes out of engagement with the gear 74. The maximum rotating angle of the gear 74 corresponding to the maximum scan transporting amount of the scanner 3 to the position of $R_2$ in FIG. 9 and the position as shown in FIG. 13 is set so as not to engage with the sector gear 73a again even if the sector gear 73a is slipped out of engagement with the gear 74.

Figure 13:
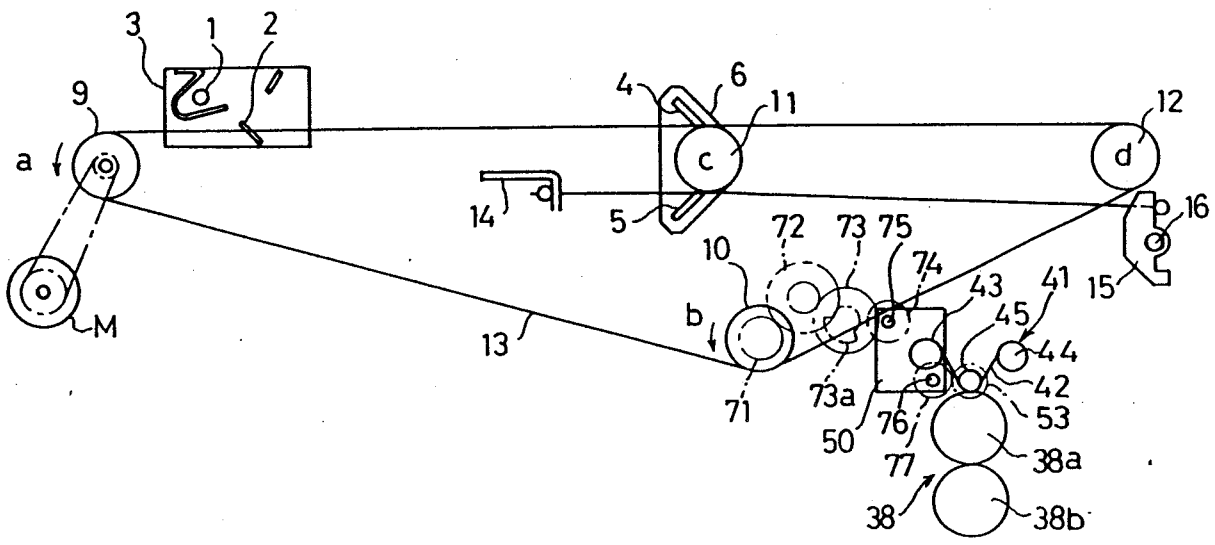
Figure 14:
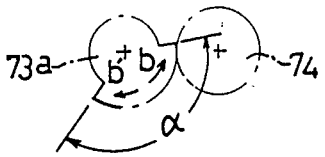
FIGS. 14 through 17 are schematic views illustrating the state of transmission in the connecting portion between a driving means and a cleaning device of a scanning optical system.

Accordingly, even if the scan transporting amount of the scanner 3 is changed from the position in FIG. 12 to the position shown in FIG. 13 corresponding to the size of copy paper and the like, a constant amount of movement corresponding to the sector angle $\alpha$ of the sector gear 73a is transmitted to the gear 74 on the side of the speed reducer 50 from the idle pulley 10 in the direction of either b or b' at the initial scanning stage of the scanner 3 and at the end of the returning movement. The speed reducer 50 reduces the rotation of an input shaft 75 at a predetermined ratio and output to an output shaft 76, to which a gear 77 is directly connected. The gear 77 is engaged with a link gear 53 which is directly connected to a pressure roller 45, and the link gear 53 and a link gear 54 on one end of a take-up roller 44 are engaged with each other through a pair of a middle gears 55. Thus, the take-up roller 44 of the cleaning device 41 and the pressure roller 45 are driven always a constant amount when the scanner returns to the original position irrespective of the transporting amount of the scanner 3 by using a driving motor M of the scanning optical system. The cleaning of the fixing roller 38*a* is carried out by delivering a predetermined amount of the cleaning web 42 every time scanning is carried out thereby avoiding unnecessary and wasteful rolling up of the cleaning web 42.

Figure 11:
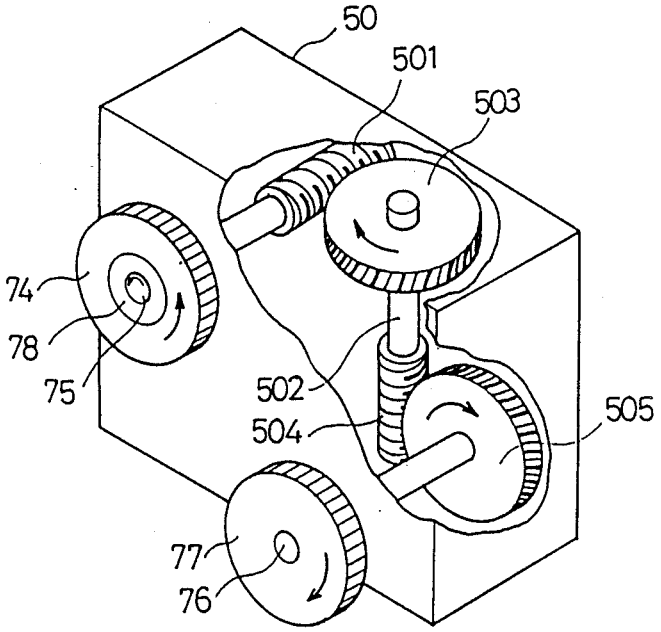
FIG. 11 is a perspective view showing an internal mechanism of a speed reducer of the mechanism shown in FIG. 10.

FIG. 11 shows a worm speed reducer mechanism in two stages provided between the input shaft 75 and the output shaft 76 of the speed reducer 50 the same as that of the first embodiment. There is no difference in the remainder of the structure from the first embodiment of the present invention.

However, the scanner 3 is moved by the driving of the motor M at the velocity of v/n (wherein n is magnification), while the movable member 6 is moved at the velocity of v/2n. The scanning length is, therefore, varied according to magnification variation, and the image of a document is scanned by movement of a scanning optical system at the speed corresponding, to the magnification variation, thereby irradiating the image on the photoconductive drum 21 disposed under the scanning optical system. The photoconductive drum 21 is rotatably driven at a circumferential velocity v, and a latent image formed by the scanning velocity v/n corresponds to a predetermined magnification in the circumferential direction. The magnification of the latent image in width direction corresponds to the magnification set by movement of the lens 7 in the direction of a light axis.

In the structure described above, when a print switch is turned on, the driving motor M starts revolving, and a driving pulley 9 rotates in the direction of arrow a while an idle pulley 10, a scan pulley 11 and a fixed pulley rotate in the direction of arrows b,c and d through a wire 13. Corresponding to this movement, the scanner 3 runs along an unillustrated guide rail in the direction of arrow a at the velocity of v/n while the movable member 6 runs to the direction of arrow s at the velocity of v/2n. The scanner 3 while running scans a document placed on a document support glass table 20 by irradiating by an exposure lamp 1, and an electrostatic latent image is formed on the photoconductive drum 21 by reflected light through the optical system. When the scanner 3 is finished the scanning after running a predetermined amount, the driving motor start reverse revolving and the scanner 3 and the movable member 6 return to the original position in the direction of arrow s'.

On the other hand, while the scanning is being carried out, the an idle pulley 10 rotates to the direction b and in the direction b' when the scanner returns to the original position. At this stage, only the predetermined amount of revolution corresponding to the sector angle of $\alpha$ is transmitted to an input shaft 75 from the idle pulley 10 by the one way clutch, which is then transmitted to the link gear 53 through the gear 77 directly connected to the output pulley 76 of the speed reducer 50. Thereafter, the pressure roller 45 and the roller 45 are driven.

In the speed reducer 50, for instance, the speed is reduced to 1/1000 and only the amount of cleaning web required for cleaning a fixing roller 38*a* is supplied. Thus, in the cleaning device of the optical system, cleaning of the fixing roller 38*a* can be performed by supplying a predetermined amount of cleaning web. The instruction for exchanging the cleaning web based on the number of sheets being printed can also be given easily since the amount of the cleaning web to be supplied is predetermined irrespective of the size of paper and the like.

In the first and second embodiment of the present invention, the cleaning device for the fixing roller has been exemplified; however, it may also be applicable to other rollers and the photoconductive drum with which the cleaning web is being utilized.

Figure 18:
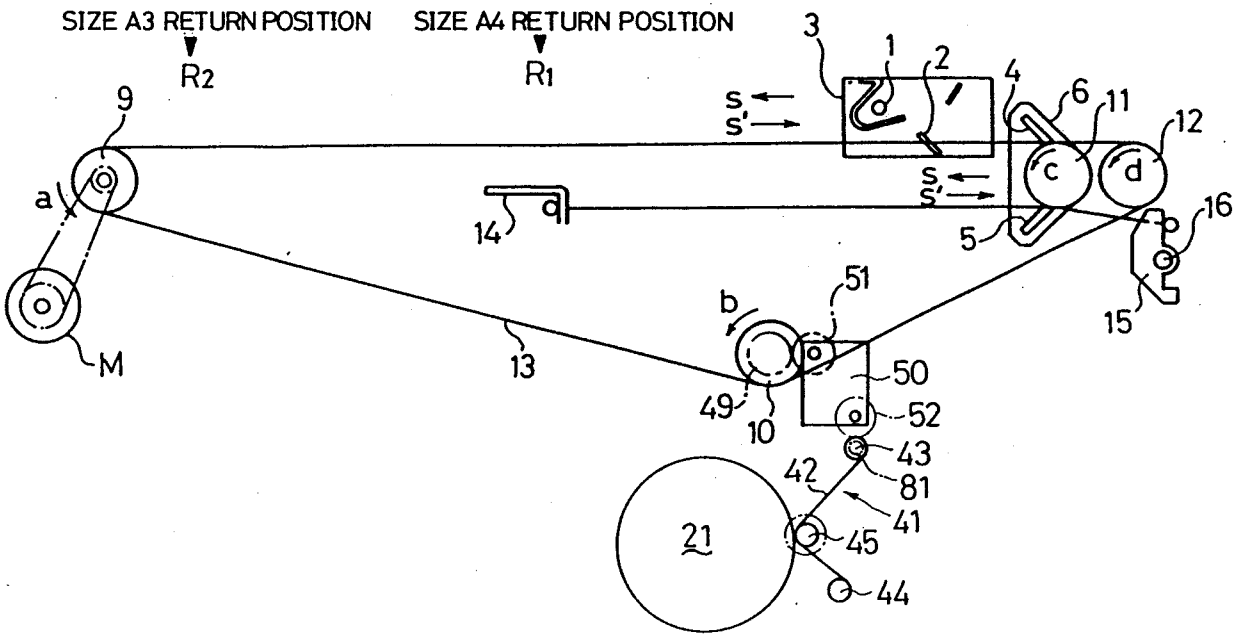
FIG. 18 is a schematic view illustrating a scanning optical system and a driving system of a cleaning mechanism in a copying machine according to a third embodiment of the present invention.

FIG. 18 illustrates the third embodiment of the present invention. In the embodiment, a cleaning device 41 is provided for cleaning a photoconductive drum 21, and the cleaning device 41 is connected to an idle pulley 10 of a driving mechanism in a scanning optical system through a speed reducer 50 the same as the one in the first embodiment.

The cleaning web 42 is rolled up every time a scanning action is performed, thereby cleaning the surface of the photoconductive drum 21 with a new portion of the cleaning web, and the toner remaining on the surface of the photoconductive drum 21 can be fully removed. An output gear 52 of a speed reducer 50 is arranged to transmit rotation to a pressure roller 45 and a take-up roller 44 through an idle gear 81 disposed on a rotating shaft of a web roller 43. However, a driving system such as the cleaning device 41 may be designed in various ways without any problem.

What is claimed is:

1. A copying apparatus, comprising:

a photoconductive drum;

a scanning means for scanning a document placed on a document support table and irradiating an image of the scanned document on a surface of said photoconductive drum, said scanning means having a scanning member movable from a scanning starting position and a scanning ending position and back to said scanning starting position, and a means for driving said scanning member in said movement;

a developing means for developing an electrostatic latent image formed on the photoconductive drum into a toner image;

a cleaning means for removing toner remaining on the surface of said photoconductive drum after a toner image has been removed from said drum, said cleaning means having a cleaning web in contact with said surface and a means for transporting said cleaning web for changing the portion of said cleaning web contacting said surface; and a connecting means for connecting said transporting means for the cleaning web to said driving means for said scanning means, said connecting means including means for transmitting a driving force of said driving means to said transporting means as said scanning member returns to the scanning starting position from the scanning ending position.

2. A copying apparatus as claimed in claim 1 in which said connecting means includes a one-way clutch.

3. A copying apparatus as claimed in claim 1 in which said cleaning means includes a roller for delivering the cleaning web, a roller for rolling up the cleaning web, and a member for pressing the cleaning web into contact with the surface of said photoconductive member.

4. A copying apparatus as claimed in claim 1 further comprising:

a means for feeding a copy paper;

a means for transferring the toner image on the photoconductive drum onto copy paper; and means for varying the scanning ending position of the scanning member according to the size of copy paper fed.

5. A copying apparatus, comprising:

a photoconductive drum;

a scanning means for scanning a document placed on a document support table and irradiating an image of the scanning document on a surface of said photoconductive drum, said scanning means having a scanning member movable from a scanning starting position and a scanning ending position and back to said scanning starting position, and a means for driving said scanning member in said movement;

a developing means for developing an electrostatic latent image formed on the photoconductive drum into a toner image;

a cleaning means for removing toner remaining on the surface of said photoconductive drum after a toner image has been removed from said drum, said cleaning means having a cleaning web in contact with said surface and a means for transporting said cleaning web for changing the portion of said cleaning web contacting said surface; and a connecting means for connecting said transporting means for the cleaning web to said driving means for said scanning means, said connecting means including means for transmitting a driving force of said driving means to said transporting means only as said scanning member moves within a predetermined range of movement.

6. A copying apparatus as claimed in claim 1 in which said connecting means includes a sector gear.

7. A copying apparatus, comprising:

a photoconductive drum;

a scanning means for scanning a document placed on a document support table and irradiating an image of the scanned document on a surface of said photoconductive drum, said scanning means having a scanning member movable from a scanning starting position and a scanning ending position and back to said scanning starting position, and a means for driving said scanning member in said movement;

a developing means for developing an electrostatic latent image formed on the photoconductive drum into a toner image;

a cleaning means for removing toner remaining on the surface of said photoconductive drum after a toner image has been removed from said drum, said cleaning means having a cleaning web in contact with said surface and a means for transporting said cleaning web for changing the portion of said cleaning web contacting said surface; and a connecting means for connecting said transporting means for the cleaning web to said driving means for said scanning means, said connecting means including speed reducing means having a predetermined speed ratio for making the amount of cleaning web transported less than the distance said scanning member is moved.

8. A copying apparatus, comprising:

a photoconductive drum;

a scanning means for scanning a document placed on a document support table and irradiating an image of the scanned document on a surface of said photoconductive drum, said scanning means having a scanning member movable from a scanning starting position and a scanning ending position and back to said scanning starting position;

a developing means for developing an electrostatic latent image formed on the photoconductive drum into a toner image;

a cleaning means for removing toner remaining on the surface of said photoconductive drum after a toner image has been removed from said drum, said cleaning means having a cleaning web in contact with said surface and a means for transporting said cleaning web for changing the portion of said cleaning web contacting said surface; and a driving means for driving said transporting means for transporting said cleaning web for a distance corresponding to the distance from the scanning starting position and the scanning ending position.

9. A copying apparatus, comprising:

a photoconductive drum;

a scanning means for scanning a document placed on a document support table and irradiating an image of the scanned document on a surface of said photoconductive drum, said scanning means having a scanning member movable from a scanning starting position and a scanning ending position and back to said scanning starting position, and a means for driving said scanning member in said movement;

a developing means for developing an electrostatic latent image formed on the photoconductive drum into a toner image;

a cleaning means for removing toner remaining on the surface of said photoconductive drum after a toner image has been removed from said drum, said cleaning means having a cleaning web in contact with said surface and a means for transporting said cleaning web for changing the portion of said cleaning web contacting said surface; and a connecting means for connecting said transporting means for the cleaning web to said driving means for said scanning means, said connecting means including means for transmitting a driving force of said driving means to said transporting means as said scanning member moves the distance between the scanning starting and the scanning ending position.

10. A copying apparatus, comprising:

a photoconductive drum;

a scanning means for scanning a document placed on a document support table and irradiating an image of the scanned document on a surface of said photoconductive drum, said scanning means having a scanning member movable from a scanning starting position and a scanning ending position and back to said scanning starting position, and a means for driving said scanning member in said movement;

a developing means for developing an electrostatic latent image formed on the photoconductive drum into a toner image;

means for transferring the toner image on said photoconductive drum onto a copy paper;

means for fixing the toner image of the copy paper, said fixing means having a pair of rollers, one of which contacts the side of the copy paper having the toner image thereon;

a cleaning means for removing toner remaining on the surface of said one roller after a toner image has been said drum, said cleaning means having a cleaning web in contact with the surface of said one roller and a means for transporting said cleaning web for changing the portion of said cleaning web contacting said surface; and a connecting means for connecting said transporting means for the cleaning web to said driving means for said scanning means, said connecting means including means for transmitting a driving force of said driving means to said transporting means as said scanning member returns to the scanning starting position from the scanning ending position.

11. A copying apparatus as claimed in claim 10 in which said connecting means includes a one-day clutch.

12. A copying apparatus as claimed in claim 10 in which said cleaning means includes a roller for delivering the cleaning web, a roller for rolling up the cleaning web, and a member for pressing the cleaning web into contact with the surface of said said one roller.

13. A copying apparatus as claimed in claim 10 further comprising:

a means for feeding a copy paper;

a means for transferring the toner image on the photoconductive drum onto copy paper; and means for varying the scanning ending position of the scanning member according to the size of copy paper fed.

14. A copying apparatus, comprising:

a photoconductive drum;

a scanning means for scanning a document placed on a document support table and irradiating an image of th scanned document on a surface of said photoconductive drum, said scanning means having a scanning member movable from a scanning starting position and a scanning ending position and back to said scanning starting position, and a means for driving said scanning member in said movement;

a developing means for developing an electrostatic latent image formed on the photoconductive drum into a toner image;

means for transferring the toner image on said photoconductive drum onto a copy paper;

means for fixing the toner image of the copy paper, said fixing means having a pair of rollers, one of which contacts the side of the copy paper having the toner image thereon;

a cleaning means for removing toner remaining on the surface of said one roller after a toner image has been fixed on a copy paper, said cleaning means having a cleaning web in contact with the surface of said one roller and a means for transporting said cleaning web for changing the portion of said cleaning web contacting said one roller; and a connecting means for connecting said transporting means for the cleaning web to said driving means for said scanning means, said connecting means including means for transmitting a driving force of said driving means to said transporting means only as said scanning member moves within a predetermined range of movement.

15. A copying apparatus as claimed in claim 14 in which said connecting means includes a sector gear.

16. A copying apparatus, comprising:

a photoconductive drum;

a scanning means for scanning a document placed on a document support table and irradiating an image of the scanned document on a surface of said photoconductive drum, said scanning means having a scanning member movable from a scanning starting position and a scanning ending position and back to said scanning starting position, and a means for driving said scanning member in said movement;

a developing means for developing an electrostatic latent image formed on the photoconductive drum into a toner image;

means for transferring the toner image on said photoconductive drum onto a copy paper;

means for fixing the toner image of the copy paper, said fixing means having a pair of rollers, one of which contacts the side of the copy paper having the toner image thereon;

a cleaning means for removing toner remaining on the surface of said one roller after a toner image has been fixed to a copy paper, said cleaning means having a cleaning web in contact with the surface of said one roller and a means for transporting said cleaning web for changing the portion of said cleaning web contacting said surface of said one roller; and a connecting means for connecting said transporting means for the cleaning web to said driving means for said scanning means, said connecting means including speed reducing means having a predetermined speed ratio for making the amount of cleaning web transported less than the distance said scanning member is moved.

17. A copying apparatus, comprising:

a photoconductive drum:

a scanning means for scanning a document placed on a document support table and irradiating an image of the scanned document on a surface of said photoconductive drum, said scanning means having a scanning member movable from a scanning starting position and a scanning ending position and back to said scanning starting position;

a developing means for developing an electrostatic latent image formed on the photoconductive drum into a toner image;

means for transferring the toner image on said photoconductive drum onto a copy paper;

means for fixing the toner image of the copy paper, said fixing means having a pair of rollers, one of which contacts the side of the copy paper having the toner image thereon;

a cleaning means for removing toner remaining on the surface of said one roller after a toner image has been fixed to a copy paper, said cleaning means having a cleaning web in contact with the surface of said one roller and a means for transporting said cleaning web for changing the portion of said cleaning web contacting said surface of said one roller; and a driving means for driving said transporting means for transporting said cleaning web for a distance corresponding to the distance from the scanning starting position and the scanning ending position.

18. A copying apparatus, comprising:

a photoconductive drum;

a scanning means for scanning a document placed on a document support table and irradiating an image of the scanned document on a surface of said photoconductive drum, said scanning means having a scanning member movable from a scanning starting position and a scanning ending position and back to said scanning starting position, and a means for driving said scanning member in said movement;

a developing means for developing an electrostatic latent image formed on the photoconductive drum into a toner image;

means for transferring the toner image on said photoconductive drum onto a copy paper;

means for fixing the toner image of the copy paper, said fixing means having a pair of rollers, one of which contacts the side of the copy paper having the toner image thereon;

a cleaning means for removing toner remaining on the surface of said one roller after a toner image has been fixed to a copy paper, said cleaning means having a cleaning web in contact with said surface of said one roller and a means for transporting said cleaning web for changing the portion of said cleaning web contacting said surface of said one roller; and a connecting means for connecting said transporting means for the cleaning web to said driving means for said scanning means, said connecting means including means for transmitting a driving force of said driving means to said transporting means as said scanning member moves the distance between the scanning starting and the scanning ending position.

* * * * *